United States Patent [19]

Lissant

[11] 4,084,940

[45] Apr. 18, 1978

[54] EMULSIONS OF ENHANCED IGNITIBILITY

[75] Inventor: Kenneth J. Lissant, St. Louis, Mo.

[73] Assignee: Petrolite Corporation, St. Louis, Mo.

[21] Appl. No.: 535,559

[22] Filed: Dec. 23, 1974

[51] Int. Cl.[2] ..... C10L 1/32

[52] U.S. Cl. ..... 44/51

[58] Field of Search ..... 44/51; 60/217

[56] References Cited

U.S. PATENT DOCUMENTS

| | | | |
|---|---|---|---|
| 1,079,257 | 11/1913 | Mitchell | 44/51 |
| 1,533,158 | 4/1925 | Belknap | 44/51 |
| 1,726,018 | 8/1929 | Farrar | 44/51 |
| 3,352,109 | 11/1967 | Lissant | 149/18 |

*Primary Examiner*—Daniel E. Wyman
*Assistant Examiner*—Mrs. Y. Harris-Smith
*Attorney, Agent, or Firm*—Sidney B. Ring; Hyman F. Glass

[57] ABSTRACT

This invention relates to a safety fuel which is characterized as a combustible high internal phase ratio emulsion which, although relatively non-ignitible, can be ignited under conventional ignition. This safety fuel is a high internal phase ratio emulsion having a combustible internal phase and an aqueous external phase containing sufficient volatile combustible materials in the external phase to ignite under conventional ignition conditions.

11 Claims, No Drawings

EMULSIONS OF ENHANCED IGNITIBILITY

In certain of my patents such as in U.S Pat. No. 3,352,109 I have described high internal phase ratio emulsions of jet and rocket fuels which are less hazardous in the event of an accidental spill or crash. The tendency of the emulsified fuel to be atomized and ignited in a fireball on impact and the tendency of the fuel to run and spread out is significantly minimized, thus greatly reducing the fire hazard. The nature of high internal phase ratio emulsions is such that the combustible material is encapsulated in a film of external phase which retards the vaporization rate thereby keeping the vapor envelope outside of the explosive ignitible or combustible range.

While the reduction of volatility rates is highly desirable from a safety standpoint, it creates problems in attempting to ignite such fuels when they are burned in engines, furnaces or other devices. In testing the emulsified jet fuels on test stand, "hot starts" were obtained in some instances due to the delay in ignition when starting out on a cold engine. In stationary power generating devices when the combustion is intermittant and controlled by thermostats and other demand circuits, repeated reignition is essential.

I have now devised a composition which is more readily ignitible by conventional ignition devices. Although it retains its lower evaporation rate and non-Newtonian property which reduce vaporizing and spreading in the event of spills, the incorporation of volatile miscible combustible components in the aqueous external phase, without seriously changing the physical properties or stability, greatly enhances its ignitibility with conventional ignition devices.

The emulsions of the present invention contain the components of the emulsions of U.S. Pat. No. 3,352,109 which is by reference incorporated into the present application as a part hereof. They contain the same or similar oily phases, the same or similar non-oily phases, the same or similar emulsions. They are made by the same or similar processing techniques, have the same or similar properties which they possess with the proviso that these emulsions are more ignitible with conventional ignition devices.

This enhanced ignitibility is achieved by dissolving in the aqueous phase a volatile combustible composition which has sufficient vapor pressure to ignite under such conditions.

A wide variety of such volatile and combustible compositions can be employed provided they achieve the desired property. In general, a combustible composition having a vapor pressure at room temperature at or above that of water can be employed.

Typical compositions comprise alcohols such as methanol and ethanol, etc., ketones such as acetone, methyl ethyl ketone, etc., or other materials which are soluble in water, alcohol or other aqueous systems which also contain other solvents.

The amount of combustible volatile component present in the aqueous phase can vary widely such as from 1 to 95% of the aqueous phase, such as from 10–75%, for example, from 15 to 50%, but preferably from 25 to 40%.

In addition, the aqueous phase can contain other components such as anti-freeze agents such as ethyleneglycol, bactericides, corrosion inhibitors, etc.

Besides the usual combustion system employing ignition devices such as occur in internal combustion engines such as gasoline engines, diesel engines, fuel oil systems, etc., the more readily ignitible fuel of this invention also may be employed in oil lamps, charcoal lighters, cigarette lighters, etc.

As is well known, cigarette lighters have become an important article of commerce. Because conventional cigarette lighters contain highly combustible fluids, they are potentially dangerous. Therefore, it is desirable to employ safety fluid for cigarette lighters.

When a safety fuel such as a high internal phase ratio emulsion is employed in the conventional cigarette lighter with a spark ignition device, it is difficult to ignite. However, I have now discovered that the composition of this invention can be employed in cigarette lighters — it is both safe and ignitible.

The high internal phase ratio emulsions are "non-Newtonian" which means a fluid of thixotropic or pseudoplastic character. By definition, these fluids possess the property of exhibiting variable apparent viscosity when the shear rate is varied. Stated another way, when these fluids are pumped at low shear rates, they behave as though they are extremely viscous fluids; but as the pumping rate is increased and concomitantly the shear rate increases, the fluids appear to "shear thin" and then behave as though they have low viscosities.

The non-Newtonian fluids employed in the practice of this invention, however, are characterized by the fact that when at rest or under low shear conditions they behave like elastic solids or extremely viscous liquids; but when subjected to moderate shear rates such as are encountered in pumping through pipes at practical, but not extremely rapid rates, the fluids behave as though they were low viscosity media. These emulsions contain an internal phase which is the major part of the emulsions; for example, at least about 60%, such as at least about 80%, but preferably in excess of about 90%, but volume, and often 95% or higher.

These thixotropic emulsions which have the characteristics of solids at rest and liquids when force is exerted on them, have the following advantages:

1. Nonadhesive — They do not tend to stick to the sides of the container or system.
2. Viscosity — The apparent rest viscosity is greater than 1000 cps, generally in the range of 10,000–100,000 or greater, preferably 50,000–100,000 cps or more.
3. Temperature Stability — Increased temperature has little effect on viscosity until the critical stability temperature is reached at which point the emulsion breaks into its liquid components. This permits a wide temperature its liquid components. This permits a wide temperature range of use.
4. Shear Stability — Emulsions may be subjected repeatedly to shear without degradation so long as the critical shear point is not reached. At this point the emulsions breaks. However, the critical shear point is sufficiently high to permit high normal pumping and handling.
5. Quality Control — With these emulsions it is easy to reproduce batches with identical properties due to the absence of any "gel" structure.
6. Solids Content — Emulsions will flow well even with high solids content since they have a broad range between rest viscosity and viscosity under modest shear.

In contrast to very high volume percent solid loading in gels or slurries which result in a "putty," these emulsions can suspend such solids in the internal phase while allowing the external phase to govern "flowability."

The following examples are presented by way of illustration and not of limitation.

EXAMPLE 1

An external phase was prepared consisting of 12% of the emulsifier described in Example 21 of U.S. Pat. No. 3,352,109 (1 part crude phenol + 2.28 parts EtO), 12% of an emulsifier as described in Example 1 of the above U.S. patent (1 part n-decanol + 1.96 parts PRO + 2.61 parts EtO), 30% of ethylene glycol and 46% of water. Five milliliters of the above external phase was placed in a 400 milliliter tall form beaker and diluted with 5 milliliters of water. The beaker was fitted with a split disk stirrer and a total of 250 milliliters of commercial cigarette lighter fluid was added incrementally with stirring. A translucent thixotropic high-internal-phase-ratio, oil in water emulsion resulted which was a 96% oil in water emulsion.

EXAMPLE 1A

The above procedure was repeated except that the external phase was diluted with 2 milliliters of water and 3 milliliters of anhydrous methanol. Again, a translucent thixotropic high-internal-phase-ration oil in water emulsion resulted. Both of these emulsions were stable under storage for extended periods of time. A one-half milliliter portion of the emulsion of EXAMPLE 1 was placed on a metal plate and sparks directed to it from a conventional welding torch friction lighter. Occasionally, ignition could be achieved, but ignition was at best erratic and difficult. When this procedure was repeated with the emulsion containing methanol, EXAMPLE 1A, it was found that ignition was achieved more dependably.

EXAMPLE 2

The emulsion of EXAMPLE 1A can be employed in a wickless cigarette lighter and ignited with the conventional sparking mechanism.

EXAMPLE 3

The emulsion of EXAMPLE 1A containing ethanol instead of methanol was employed as a fire starter for charcoal, wood and logs.

I claim:

1. A high internal phase ratio fuel in water emulsion, said emulsion containing sufficient volatile combustible materials in the exterior phase to render the emulsion more ignitible.

2. The emulsion of claim 1 where the volatile combustible material is an alcohol.

3. The high internal phase ratio fuel in water emulsion of claim 1 which is a thixotropic, hydrocarbon-in-water emulsion fuel comprising (1) water, (2) an emulsifiable hydrocarbon, and (3) an emulsifying agent, said hydrocarbon being present in said emulsion fuel in an amount of at least 80% hydrocarbon by volume of the emulsion, said emulsion having the characteristics of a solid fuel when at rest and the characteristics of a liquid fuel when a force is exerted upon it, said emulsion tending to be non-adhesive, said emulsion having a critical shear point sufficient to permit pumping at high rates, and said emulsion having an apparent rest viscosity greater than about 1000 CPS and wherein the additional sufficient volatile combustible material is in the exterior aqueous phase to render the emulsion more ignitible.

4. The emulsion of claim 3 where the volatile combustible material is methanol, ethanol, acetone or methyl ethyl ketone.

5. The emulsion of claim 1 where the volatile combustible material is methanol, ethanol, acetone or methyl ethyl ketone.

6. The emulsion of claim 2 where the volatile combustible material is methanol.

7. The emulsion of claim 2 where the volatile combustible material is ethanol.

8. The emulsion of claim 4 where the volatile combustible material is methanol.

9. The emulsion of claim 4 where the volatile combustible material is ethanol.

10. The emulsion of claim 1 wherein the volatile combustible material has a vapor pressure at room temperature at or above that of water.

11. The emulsion of claim 3 wherein the volatile combustible material has a vapor pressure at room temperature at or above that of water.

* * * * *